United States Patent [19]

Merchant et al.

[11] Patent Number: 4,812,256

[45] Date of Patent: Mar. 14, 1989

[54] AZEOTROPIC COMPOSITIONS OF 1,1-DIFLUORO-1,2,2-TRICHLOROETHANE AND METHANOL, ETHANOL, ISOPROPANOL OR N-PROPANOL

[75] Inventors: Abid N. Merchant, Wilmington, Del.; Kenneth C. Burke, Westfield, N.J.; Jill M. Redenbaugh, Winston-Salem, N.C.

[73] Assignee: E. I. Du Pont de Nemours and Company, Wilmington, Del.

[21] Appl. No.: 183,989

[22] Filed: Apr. 20, 1988

[51] Int. Cl.[4] ..... C11D 7/50

[52] U.S. Cl. ..... 252/162; 252/170; 252/171; 252/364; 134/38; 134/40

[58] Field of Search ..... 252/162, 170, 171, 364; 134/38, 40

[56] References Cited

U.S. PATENT DOCUMENTS

| | | | |
|---|---|---|---|
| 4,378,303 | 3/1983 | Hiramoto et al. | 252/171 |
| 4,654,160 | 3/1987 | Wilson et al. | 252/171 |
| 4,655,956 | 4/1987 | Basu et al. | 252/171 |
| 4,659,505 | 4/1987 | Enjo et al. | 252/171 |

*Primary Examiner*—Paul Lieberman
*Assistant Examiner*—Hoa Van Le
*Attorney, Agent, or Firm*—James E. Shipley

[57] ABSTRACT

Azeotropic mixtures of 1,1-difluoro-1,2,2-trichloroethane (HCFC-122) with methanol, ethanol, isopropanol or n-propanol, the azeotropic mixtures being useful in solvent cleaning applications.

15 Claims, No Drawings

AZEOTROPIC COMPOSITIONS OF 1,1-DIFLUORO-1,2,2-TRICHLOROETHANE AND METHANOL, ETHANOL, ISOPROPANOL OR N-PROPANOL

BACKGROUND OF THE INVENTION

As modern electronic circuit boards evolve toward increased circuit and component densities, thorough cleaning of the boards after soldering becomes more important. Current industrial processes for soldering electronic components to circuit boards involve coating the entire circuit side of the board with a flux and thereafter passing this coated side of the board over preheaters and through molten solder. The flux cleans the conductive metal parts and promotes adheesion of the solder. Commonly used fluxes consist, for the most part, of rosin used alone or with activating additives such as amine hydrochlorides or oxalic acid derivatives.

After soldering, which thermally degrades part of the rosin, the flux and flux residues are often removed from the board with an organic solvent. The requirements of such a solvent are stringent: a solvent should have a low boiling point, be non-flammable, have low toxicity and exhibit high solvent power so that flux and flux residues can be removed without damage to the substrate being cleaned.

While boiling, flammability and solvent power characteristics can often be adjusted by preparing mixtures of solvents, these mixtures are often unsatisfactory because they fractionate to an undesirable degree during evaporation or boiling. Such mixtures also fractionate during recovery, making it difficult to reuse a solvent mixture with the original composition.

On the other hand, azeotropic mixtures, with their constant boiling and constant composition characteristics, have been found to be very useful. Azeotropic mixtures exhibit either a maximum or minimum boiling point and do not fractionate upon boiling. These characteristics are also important in the use of the solvent compositions to remove solder fluxes and flux residues from printed circuit boards. Preferential evaporation of the more volatile components of the solvent mixtures, which would be the case if they were not azeotropes or azeotrope-like, would result in mixtures with changed compositions having less desirable properties, such as lower solvency for rosin fluxes and less inertness toward the electrical components. Unchanging composition during use is also desirable in vapor degreasing operations where redistilled material is usually used for final rinse-cleaning. Thus, a vapor defluxing and degreasing system acts as a still. Unless the solvent composition exhibits a constant boiling point, i.e., is a pure component, an azeotrope or is azeotrope-like, fractionation will occur and undesirable solvent distribution may act to upset the safety and effectiveness of the cleaning operation.

A number of chlorofluorocarbon-based azeotropic compositions have been discovered and, in some cases, used as solvents for the removal of solder fluxes and flux residues from printed circuit boards and for miscellaneous vapor degreasing applications. Some of these chlorofluorocarbons currently being used for cleaning and other applications have been theoretically linked to the depletion of the ozone layer. As early as the 1970's, with the initial emergence of the ozone theory, it was known that the introduction of the hydrogen moiety into previously fully halogenated chlorofluorocarbons reduced the chemical stability of these compounds. Hence, these now destabalized compounds would be expected to degrade in the atmosphere and not reach the stratospheric ozone layer. What is also needed, therefore, are substitute chlorofluorocarbons which have low theoretical ozone depletion potential.

Unfortunately, as is recognized in the art, it is not possible to predict the formation of azeotropes. This obviously complicates the search for new azeotropic compositions which have application in the field. Nevertheless, there is a constant effort in the art to discover new azeotropes or azeotrope-like compositions which have desirable solvency characteristics and particularly a greater range of solvency power.

SUMMARY OF THE INVENTION

According to the present invention, an azeotrope or azeotrope-like composition has been discovered comprising an admixture of effective amounts of 1,1-difluoro-1,2,2-trichloroethane and an alcohol selected from the group consisting of methanol, ethanol, isopropanol and n-propanol, more specifically, an admixture of about 85-88 weight percent 1,1-difluoro-1,2,2-trichloroethane and about 15–12 weight percent methanol, an admixture of about 86–91 weight percent 1,1-difluoro-1,2,2-trichloroethane and about 14–9 weight percent ethanol, an admixture of about 91–95 weight percent 1,1-difluoro-1,2,2-trichloroethane and about 9–5 weight percent isopropanol, and an admixture of about 97–99 weight percent 1,1-difluoro-1,2,2-trichloroethane and about 3-1 weight percent n-propanol.

The present invention provides nonflammable azeotropic compositions which are well suited for solvent cleaning applications.

DETAILED DESCRIPTION OF THE INVENTION

The compositions of the instant invention comprise admixtures of effective amounts of 1,1-difluoro-1,2,2-trichloroethane ($CHCl_2CClF_2$, boiling point 72° C.) with an alcohol selected from the group consisting of methanol, ethanol, isopropanol and n-propanol to form an azeotrope or azeotrope-like mixture. The fluorinated material is known as HCFC-122, in the nomenclature conventional to fluorinated aliphatic compounds.

By azeotrope or azeotrope-like composition is meant constant boiling liquid admixtures of two or more substances. These admixtures behave like a single substance in that the vapor produced by partial evaporation or distillation has the same, or substantially the same, composition as does the liquid, i.e., the admixtures distill without a substantial change in composition. Constant boiling compositions characterized as azeotropes or azeotrope-like exhibit either a maximum or minimum boiling point as compared with that of nonazeotropic mixtures of the same substances.

By effective amount is meant the amount of each component of the admixture of the instant invention which, when combined, results in the formation of the azeotrope or azeotrope-like composition of the instant invention.

It is possible to characterize a constant boiling admixture, which may appear under varying guises depending on the conditions chosen, by any of several criteria:

The composition can be defined as an azeotrope of A and B, since the very term "azeotrope" is at once both definitive and limitative, requiring that effective amounts of A and B form this unique composition of matter which is a constant boiling admixture.

It is well known by those who are skilled in the art that at differing pressures, the composition of a given azeotrope will vary, at least to some degree, and changes in pressure also change, at least to some degree, the boiling point temperature. Thus, an azeotrope of A and B represents a unique type of relationship but with a variable composition depending upon temperature and/or pressure. Therefore, compositional ranges, rather than fixed compositions, are often used to define azeotropes.

Or, the composition can be defined as a particular weight percent relationship or mol percent relationship of A and B, while recognizing that such specific values describe only one particular such relationship and that, in actuality, a series of such relationships represented by A and B exists for a given azeotrope, varying by changes in pressure.

Or, recognizing that the azeotrope A and B does represent just that a series of relationships, the azeotropic series represented by A and B can be characterized by defining the composition as an azeotrope characterized by a boiling point at a given pressure, thus giving identifying characteristics without unduly limiting the scope of the invention by a specific numerical composition, which is limited by and is only as accurate as the analytical equipment available.

Binary mixtures of 85–88 weight percent HCFC-122 and 15–12 weight percent methanol are characterized as azeotropes or azeotrope-like in that mixtures within this range exhibit a substantially constant boiling point at constant pressure. Being substantially constant boiling, the mixtures do not tend to fractionate to any great extent upon evaporation or boiling. After evaporation, only a small difference exists between the composition of the vapor and the composition of the initial liquid phase. This difference is such that the compositions of the vapor and liquid phases are considered substantially identical. Accordingly, any mixture within this range exhibits properties which are characteristic of a true binary azeotrope. The binary composition consisting of about 86.4 weight percent HCFC-122 and 13.6 weight percent methanol has been established, within the accuracy of the fractional distillation method, as a true binary azeotrope, boiling at about 61° C. at substantially atmospheric pressure. It is the preferred azeotrope or azeotrope-like composition of the present invention.

Also, according to the instant invention, binary mixtures of 86–91 weight percent HCFC-122 and 14–9 weight percent ethanol are characterized as an azeotrope or azeotrope-like composition in that mixtures within this range exhibit a substantially constant boiling point at constant pressure. Being substantially constant boiling, the mixtures do not tend to fractionate to any great extent upon evaporation. After evaporation, only a small difference exists between the composition of the vapor and the composition of the initial liquid phase. This difference is so small that the compositions of the vapor and liquid phases are considered substantially identical. Accordingly, any mixture within this range exhibits properties which are characteristic of a true binary azeotrope. The binary composition consisting of about 88.2 weight percent HCFC-122 and 11.8 weight percent ethanol has been established, within the accuracy of the fractional distillation method, as a true binary azeotrope, boiling at about 66° C. at substantially atmospheric pressure.

Also, according to the instant invention, binary mixtures of 91–95 weight percent HCFC-122 and 9–5 weight percent isopropanol are characterized as an azeotrope or azeotrope-like composition in that mixtures within this range exhibit a substantially constant boiling point at constant pressure. Being substantially constant boiling, the mixtures do not tend to fractionate to any great extent upon evaporation or boiling. After evaporation, only a small difference exists between the composition of the vapor and the composition of the initial liquid phase. The difference is so small that the compositions of the vapor and liquid phases are considered substantially identical. Accordingly, any mixture within this range exhibits properties which are characteristic of a true binary azeotrope. The binary composition consisting of about 92.8 weight percent HCFC-122 and 7.2 weight percent isopropanol has been established, within the accuracy of the fractional distillation method, as a true binary azeotrope, boiling at about 70° C. at substantially atmospheric pressure.

Also, according to the instant invention, binary mixtures of 97–99 weight percent HCFC-122 and 3–1 weight percent n-propanol are characterized as an azeotrope or azeotrope-like composition in that mixtures within this range exhibit a substantially constant boiling point at constant pressure. Being substantially constant boiling, the mixtures do not tend to fractionate to any great extent upon evaporation or boiling. After evaporation, only a small difference exists between the composition of the vapor and the composition of the initial liquid phase. The difference is so small that the compositions of the vapor and liquid phases are considered substantially identical. Accordingly, any mixture within this range exhibits properties which are characteristic of a true binary azeotrope. The binary composition consisting of about 98.2 weight percent HCFC-122 and 1.8 weight percent n-propanol has been established, within the accuracy of the fractional distillation method, as a true binary azeotrope, boiling at about 71° C. at substantially atmospheric pressure.

The azeotropes of the present invention permit easy recovery and reuse of the solvent from vapor defluxing and degreasing operations because of their azeotropic nature. As an example, the azeotropic mixtures of this invention can be used in cleaning processes such as is described in U.S. Pat. No. 3,881,949, which is incorporated herein by reference.

Another important advantage of the azeotrope or azeotrope-like composition of the instant invention is that the chlorofluorocarbon component, HCFC-122, has a low ozone depletion potential of about 0.05 relative to 1.0 for fluorotrichloromethane (CFC-11) and may be useful as a substitute for chlorofluorocarbons currently being used for cleaning and other applications which have higher ozone depletion potential.

The azeotropes of the instant invention can be prepared by any convenient method including mixing or combining the desired amount of the components. A preferred method is to weigh the desired amounts of each component, combine them in an appropriate container and mix them thoroughly.

EXAMPLE 1

An apparatus consisting of a flask and a total reflux condenser was used to determine the composition versus boiling temperature characteristics for these minimum boiling azeotropes, as follows: Pure HCFC-122 was placed in the flask and brought to boiling at atmospheric pressure and the temperatures of the boiling liquid and the vapor above the boiling liquid were recorded. Small quantities of the individual alcohol (methanol, ethanol, isopropanol or n-propanol) were added to the flask. The distillation was allowed to re-equilibrate after each addition for 10–30 minutes and the temperaures of the boiling liquid and the vapor above the boiling liquid were noted for each mixture composition.

In all four cases with each alcohol, when the mixture temperatures reached the lowest boiling point for the given composition (temperatures lower than the boiling points of either pure component), the temperature recorded was that of the azeotrope at the azeotropic composition.

EXAMPLE 2

In order to verify the exact azeotropic composition and temperatures, two mixtures of HCFC-122 and the individual alcohol (methanol, ethanol, isopropanol or n-propanol) were prepared with alcohol contents slightly higher and slightly lower than the azeotropic composition. The mixtures were distilled separately in a distillation apparatus using a packed column, which contained approximately 24 theoretical plates, at total reflux. Minimum boiling azeotropes were achieved with all four mixture distillates, for the four systems. The azeotropic compositions were determined by gas chromatography to be about 86.4 weight percent HCFC-122 and about 13.6 weight percent methanol, about 88.2 weight percent HCFC-122 and about 11.8 percent ethanol, about 92.8 weight percent HCFC-122 and about 7.2 weight percent isopropanol and about 98.2 weight percent HCFC-122 and about 1.8 weight percent n-propanol.

EXAMPLE 3

Several single sided circuit boards were coated with activated rosin flux and soldered by passing the boards over a preheater to obtain a top side board temperature of approximately 200° F. and then through 500° F. molten solder. The soldered boards were defluxed separately with four azeotropic mixtures of HCFC-122 with methanol, ethanol, isopropanol and n-propanol by suspending a circuit board, first, for three minutes in the boiling sump containing an azeotropic mixture, then, one minute in the rinse sump containing the same azeotropic mixture, and thereafter, for one minute in the solvent vapor above the boiling sump. The boards thus cleaned in each azeotropic mixture had no visible residue remaining on them.

We claim:

1. The azeotrope comprising about 85-88 weight percent 1,1-difluoro-1,2,2-trichloroethane and about 15–12 weight percent methanol.

2. The azeotrope comprising about 86–91 weight percent 1,1-difluoro-1,2,2-trichloroethane and about 14–9 weight percent ethanol.

3. The azeotrope comprising about 91–95 weight percent 1,1-difluoro-1,2,2,-trichloroethane and about 9–5 weight percent isopropanol.

4. The azeotrope comprising about 97–99 weight percent 1,1-difluoro-1,2,2-trichloroethane and about 3–1 weight percent n-propanol.

5. The azeotrope composition of claim 1 wherein the composition is about 86.4 weight percent 1,1-difluoro-1,2,2-trifluoroethane and about 13.6 weight percent methanol.

6. The azeotrope composition of claim 1 wherein the composition has a boiling point of about 61° C. at substantially atmospheric pressure.

7. The azeotropic composition of claim 2 wherein the composition is about 88.2 weight percent 1,1-difluoro-1,2,2-trichloroethane and about 11.8 weight percent ethanol.

8. The azeotrope composition of claim 2 wherein the composition has a boiling point of about 66° C. at substantially atmospheric pressure.

9. The azeotrope composition of claim 3 wherein the composition is about 92.8 weight percent 1,1-difluoro-1,2,2-trichloroethane and about 7.2 weight percent isopropanol.

10. The azeotrope composition of claim 3 wherein the composition has a boiling point of about 70° C. at substantially atmospheric pressure.

11. The azeotrope composition of claim 4 wherein the composition is about 98.2 weight percent 1,1-difluoro-1,2,2-trichloroethane and about 1.8 weight percent n-propanol.

12. The azeotrope composition of claim 4 wherein the composition has a boiling point of about 71° C. at substantially atmospheric pressure.

13. A process for cleaning a solid surface which comprises treating said surface with the azeotrope composition of any one claim 1, 2, 3 or 4.

14. The process of claim 13 wherein the solid surface is a printed circuit board contaminated with flux and flux residues.

15. The process of claim 13 wherein the solid surface is a metal.

* * * * *